US007933535B2

(12) United States Patent
Deguchi

(10) Patent No.: US 7,933,535 B2
(45) Date of Patent: Apr. 26, 2011

(54) PHOTOCONDUCTOR UNIT AND IMAGE-FORMING APPARATUS INCLUDING DRUM-CLEANING UNIT

(75) Inventor: Hideaki Deguchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 450 days.

(21) Appl. No.: 11/757,669

(22) Filed: Jun. 4, 2007

(65) Prior Publication Data

US 2007/0280731 A1 Dec. 6, 2007

(30) Foreign Application Priority Data

Jun. 6, 2006 (JP) ..... 2006-157348

(51) Int. Cl.
*G03G 21/18* (2006.01)

(52) U.S. Cl. ..... 399/111; 399/113; 399/116

(58) Field of Classification Search ..... 399/111–117, 399/123

See application file for complete search history.

(56) References Cited

U.S. PATENT DOCUMENTS 5,493,366 A * 2/1996 Satoh et al. ..... 399/111
6,917,773 B2 7/2005 Maeda et al.

FOREIGN PATENT DOCUMENTS

| | | | |
|---|---|---|---|
| JP | 56140360 | A * | 11/1981 |
| JP | 6067509 | | 3/1994 |
| JP | 7160099 | | 6/1995 |
| JP | 7239640 | | 9/1995 |
| JP | 2004138853 | | 5/2004 |
| JP | 2004279839 | | 10/2004 |
| JP | 2004301957 | | 10/2004 |
| JP | 2006098509 | | 4/2006 |
| JP | 2004279846 | | 10/2007 |

* cited by examiner

*Primary Examiner* — David M Gray
*Assistant Examiner* — Ruth N Labombard
(74) *Attorney, Agent, or Firm* — Banner & Witcoff, Ltd

(57) ABSTRACT

A drum unit includes a photoconductor drum, a charger, a cleaning brush, and a drum unit case. The charger and the cleaning brush are disposed in such a manner as to face the circumferential surface of the photoconductor drum. The charger and the cleaning brush are fixed to a charger support portion of the drum unit case. The charger support portion has a filler protrusion. The filler protrusion is provided so as to fill the space between the charger and the cleaning brush.

17 Claims, 9 Drawing Sheets

PHOTOCONDUCTOR UNIT AND IMAGE-FORMING APPARATUS INCLUDING DRUM-CLEANING UNIT

CROSS-REFERENCE TO RELATED APPLICATIONS

This Nonprovisional application claims priority under 35 U.S.C. §119(a) on Patent Application No. 2006-157348 filed in Japan on Jun. 6, 2006, the entire contents of which are hereby incorporated by reference.

BACKGROUND OF THE INVENTION

1. Field of the Invention

The present invention relates to a photoconductor unit and to an image-forming apparatus having the photoconductor unit.

2. Description of the Related Art

An electrophotographic image-forming apparatus which has a photoconductor drum and a charger for uniformly charging the surface of the photoconductor drum is conventionally known. In this connection, there are known various image-forming apparatus of this type in which the flow of air around the charger is regulated during image-forming operation for forming good images, as disclosed in, for example, Japanese Patent Application Laid-Open (kokai) Nos. 2006-98509, 2004-138853, 2004-279846, and 2004-301957.

In the image-forming apparatus of this type, a white streak may appear on a formed image along the main scanning direction when image formation is performed after long-hour suspension (e.g., after suspension lasting from evening to next morning). The width of the white streak as measured along the paper transport direction is substantially equal to the width of a space between the charger and a drum-cleaning member as measured along the sub-scanning direction (along the direction of rotation of the photoconductor drum). The drum-cleaning member is configured and disposed so as to clean a circumferential surface of the photoconductor drum before the circumferential surface is uniformly charged by the charger.

The white streak prominently appears when the environment during suspension is of high temperature and high humidity (e.g., 32° C. and 80%). Also, the longer the suspension time, more prominently the white streak appears.

Taken together, the above facts imply that the white streak is induced by a phenomenon such that substances (an external additive of toner, etc.) filming the circumferential surface of the suspended photoconductor drum absorbs moisture. Conceivably, moisture absorption on the circumferential surface of the photoconductor drum results from absorption of moisture from air which is stagnant in the space between the charger and the drum-cleaning member.

SUMMARY OF THE INVENTION

An object of the present invention is to provide a photoconductor unit and an image-forming apparatus which can restrain, to possible extent, appearance of a white streak on an image which is formed after long-hour suspension.

An image-forming apparatus of the present invention includes a body frame, a photoconductor unit, and a fixing section. The photoconductor unit is attached to the body frame. The fixing section is provided adjacent to the photoconductor unit. The fixing section is configured so as to fix an image in a developing agent on a recording medium through application of heat to the recording medium which bears the image and comes from the photoconductor unit.

The photoconductor unit includes a photoconductor drum, a charger, a drum-cleaning member, a casing, and a filler member. That is, the present invention is characterized in that the photoconductor unit has the filler member.

The photoconductor drum is formed into a cylindrical shape. The charger is disposed in such a manner as to face the circumferential surface of the photoconductor drum. The drum-cleaning member is disposed adjacent to the charger and faces the circumferential surface of the photoconductor drum. The drum-cleaning member is configured so as to clean the circumferential surface of the photoconductor drum.

The charger and the drum-cleaning member are fixed to the casing. The casing is configured so as to rotatably support the photoconductor drum. The filler member is provided so as to fill a space between the charger and the drum-cleaning member.

In this configuration, the filler member fills the space between the charger and the drum-cleaning member. This can restrain stagnation of humid air in the space during suspension of an image-forming operation. Thus, absorption of moisture on the circumferential surface of the photoconductor drum can be restrained. Therefore, the configuration can restrain, to possible extent, the above-mentioned appearance of the white streak on an image which is formed after long-hour suspension.

The filler member may be formed as a separate member from the casing. In this case, the filler member is attached to the casing through insertion into the space between the charger and the drum-cleaning member.

Alternatively, the filler member may be formed as a portion of the casing which projects into the space between the charger and the drum-cleaning member. That is, the filler member is not formed as a separate member from the casing, but is formed as a portion of the casing.

The filler member may be provided in such a manner that a gap between the filler member and the circumferential surface of the photoconductor drum is narrower than a gap between the charger and the circumferential surface. Particularly, the filler member may be provided in such a manner that a gap between the circumferential surface of the photoconductor drum and the surface of the filler member which faces the circumferential surface is constantly narrower than the gap between the charger and the circumferential surface.

This configuration can more restrain the volume of a space where air can stagnate, in the space between the charger and the drum-cleaning member. This can more effectively restrain stagnation of humid air in the space between the charger and the drum-cleaning member during suspension of an image-forming operation.

The filler member may be provided in such a manner that the gap between the filler member and the circumferential surface of the photoconductor drum becomes narrower along the direction from the charger to the drum-cleaning member.

This configuration increases the flow rate of air which flows to the exterior of the space between the charger and the drum-cleaning member through the gap between the filler member and the circumferential surface of the photoconductor drum. This can more effectively restrain stagnation of humid air in the space between the charger and the drum-cleaning member during suspension of an image-forming operation.

The filler member may be disposed laterally of or above the photoconductor drum. Particularly, the filler member may be disposed at a level higher than a shaft of the photoconductor drum.

According to this configuration, the space between the charger and the drum-cleaning member which faces the circumferential surface of the photoconductor drum is formed laterally of or above the photoconductor drum. Even in this case, by filling the space with the filler member, the volume of the space is restrained to possible extent. Accordingly, this can effectively restrain absorption of moisture on the circumferential surface of the photoconductor drum, which could otherwise result from sinking of highly humid air through the space.

Thus, the configuration can restrain, to possible extent, the above-mentioned appearance of the white streak on an image, which the white streak would otherwise be formed after long-hour suspension.

The filler member may be provided at an end portion of the photoconductor unit which is on a side proximate to the fixing section.

In the case where the fixing section is provided adjacent to the photoconductor unit (particularly, in the case where the space between the charger and the drum-cleaning member is provided at the end portion of the photoconductor unit which is on the side proximate to the fixing section), humid air is apt to stagnate in the space between the charger and the drum-cleaning member.

According to the configuration of the present invention, the filler member is provided so as to fill the space between the charger and the drum-cleaning member. Therefore, even in the above-mentioned case, stagnation of humid air in the space between the charger and the drum-cleaning member can be effectively restrained.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

An embodiment of the present invention (the best mode contemplated by the applicant at the time of filing the present application) will next be described in detail with reference to the drawings.

<Overall Configuration of Laser Printer>

Figure 1:
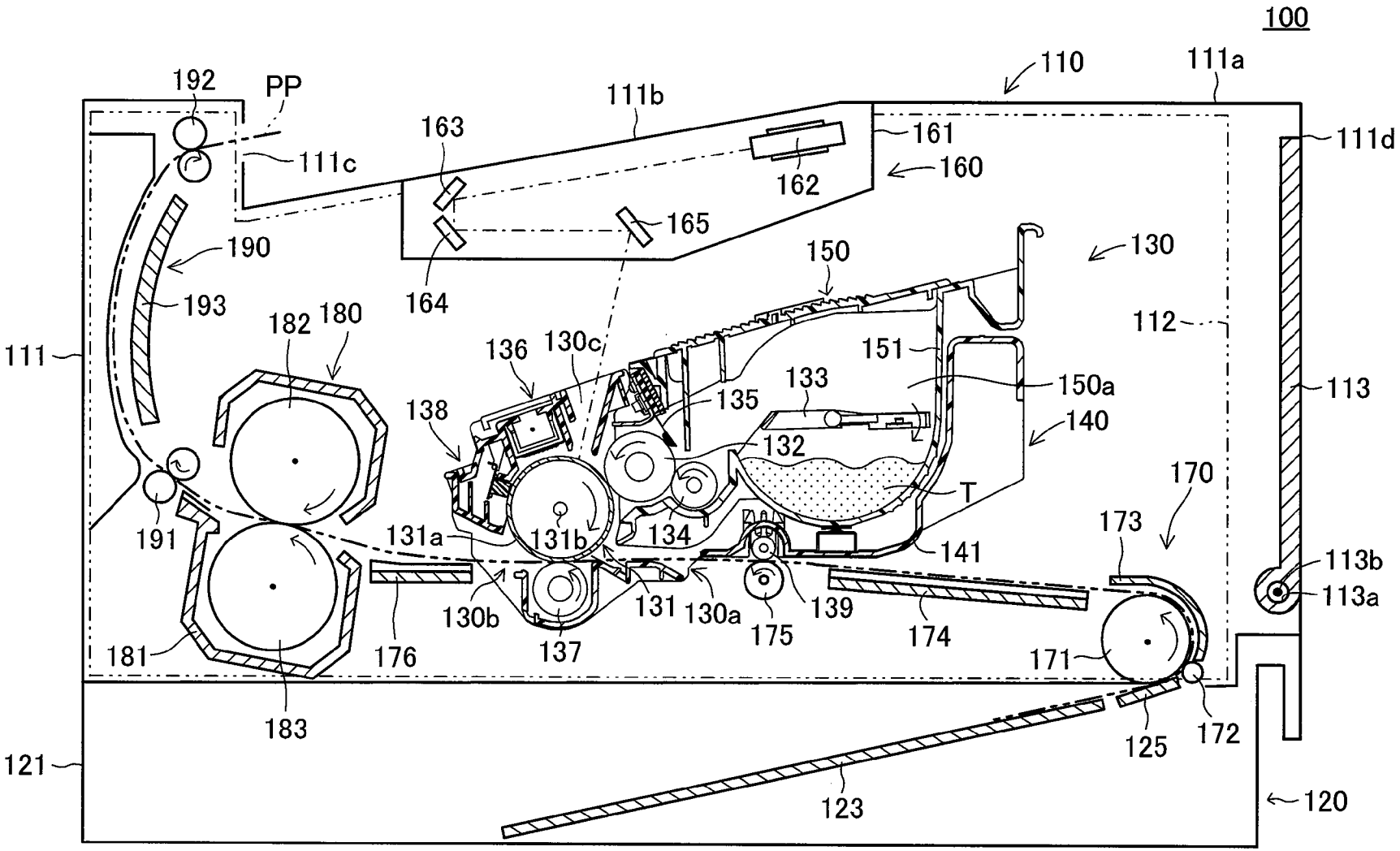
FIG. 1 is a side sectional view showing the schematic configuration of a laser printer to which an embodiment of the present invention is applied.

FIG. 1 is a side sectional view showing the schematic configuration of a laser printer 100 to which an embodiment of the present invention is applied.

Herein, a direction tangent to a paper transport path PP in FIG. 1 is called the paper transport direction. A left-right direction in FIG. 1 is called the printer front-rear direction. With respect to the printer front-rear direction, one side of the laser printer 100 is called the "front" side, and the other side is called the "rear" side. A direction perpendicular to the paper transport direction and to the printer front-rear direction is called the paper width direction (direction perpendicular to the paper on which FIG. 1 appears).

Accordingly, FIG. 1 shows a central section of the laser printer 100; in other words, FIG. 1 is a sectional view of the laser printer 100 as viewed on a section which is taken at a central portion thereof with respect to the paper width direction.

<<Body Section>>

Referring to FIG. 1, a body section 110 serves as a major portion of the laser printer 100 and includes an outer cover 111. The outer cover 111 is a casing of the body section 110; has a shape resembling a rectangular parallelepiped; and is integrally formed from a synthetic resin plate.

An upper surface 111*a* of the outer cover 111 is partially formed into a catch tray 111*b*. The catch tray 111*b* has a slope which extends obliquely downward from the front side to the rear side of the upper surface 111*a*. That is, the catch tray 111*b* includes a recess portion formed on the upper surface 111*a*.

A paper ejection port 111*c*, which is an opening portion, is formed at an upper portion of the outer cover 111 and above a lower end portion of the catch tray 111*b*. The catch tray 111*b* is configured so as to receive paper ejected from the paper ejection port 111*c*.

The body section 110 includes a body frame 112. The body frame 112 is configured so as to support various members accommodated in the body section 110. The body frame 112 is accommodated within the outer cover 111.

A front cover 113 is attached to the outer cover 111 and can open/close a front opening 111*d*, which is an opening portion formed at the front side of the outer cover 111. Specifically, the front cover 113 is configured so as to pivotally move on a pivot at its lower end along the paper transport direction for opening/closing the front opening 111*d*.

<<Feeder Unit>>

A feeder unit 120 is disposed under the body section 110. The feeder unit 120 is configured so as to feed a recording medium (paper) to the body section 110.

A feeder case 121 is a member which serves as a casing of the feeder unit 120 and has a box-like shape opening upward. The feeder case 121 is configured so as to accommodate a large number of sheets of paper of up to size A4 (210 mm width×297 mm length) in layers.

A paper-pressing plate 123 is disposed within the feeder case 121. A rear end portion of the paper-pressing plate 123 is pivotably supported by the feeder case 121. Specifically, the paper-pressing plate 123 is supported by the feeder case 121 in such a manner as to pivotally move on a pivot at its rear end, so that its front end portion can move substantially vertically. An unillustrated spring urges the front end portion of the paper-pressing plate 123 upward.

A separating pad 125 is disposed in the vicinity of a front end portion of the feeder case 121 and downstream of the paper-pressing plate 123 with respect to the paper transport direction. An unillustrated spring urges the separating pad 125 upward. A separating surface is formed on the upper surface of the separating pad 125 and is formed from a material, such as rubber, having a friction coefficient higher than that of paper.

<<Process Cartridge>>

The body section 110 accommodates a process cartridge 130. A lower end portion of the process cartridge 130 has a paper inlet opening 130*a* and a paper outlet opening 130*b*, which are slit-like opening portions intersecting the paper transport path PP and extending along the paper width direction. The process cartridge 130 is configured so as to affix toner T (developing agent) in an imagewise arrangement on paper inserted from the paper inlet opening 130*a* and to eject the paper from the paper outlet opening 130*b*.

The process cartridge 130 is detachably attached to the body frame 112. Specifically, the process cartridge 130 is configured so as to be readily attached to/detached from the body frame 112 while the front cover 113 is opened by pivotally moving its free end toward the front side (the right side in FIG. 1) so as to open up the front opening 111*d*.

An upper portion of the process cartridge 130 has a laser irradiation opening 130*c*, which is a slit-like opening. The laser irradiation opening 130*c* is formed along the paper width direction for allowing irradiation of a circumferential surface 131*a* of a photoconductor drum 131 accommodated in the process cartridge 130 with a laser beam which is modulated in accordance with image information.

Figure 2:
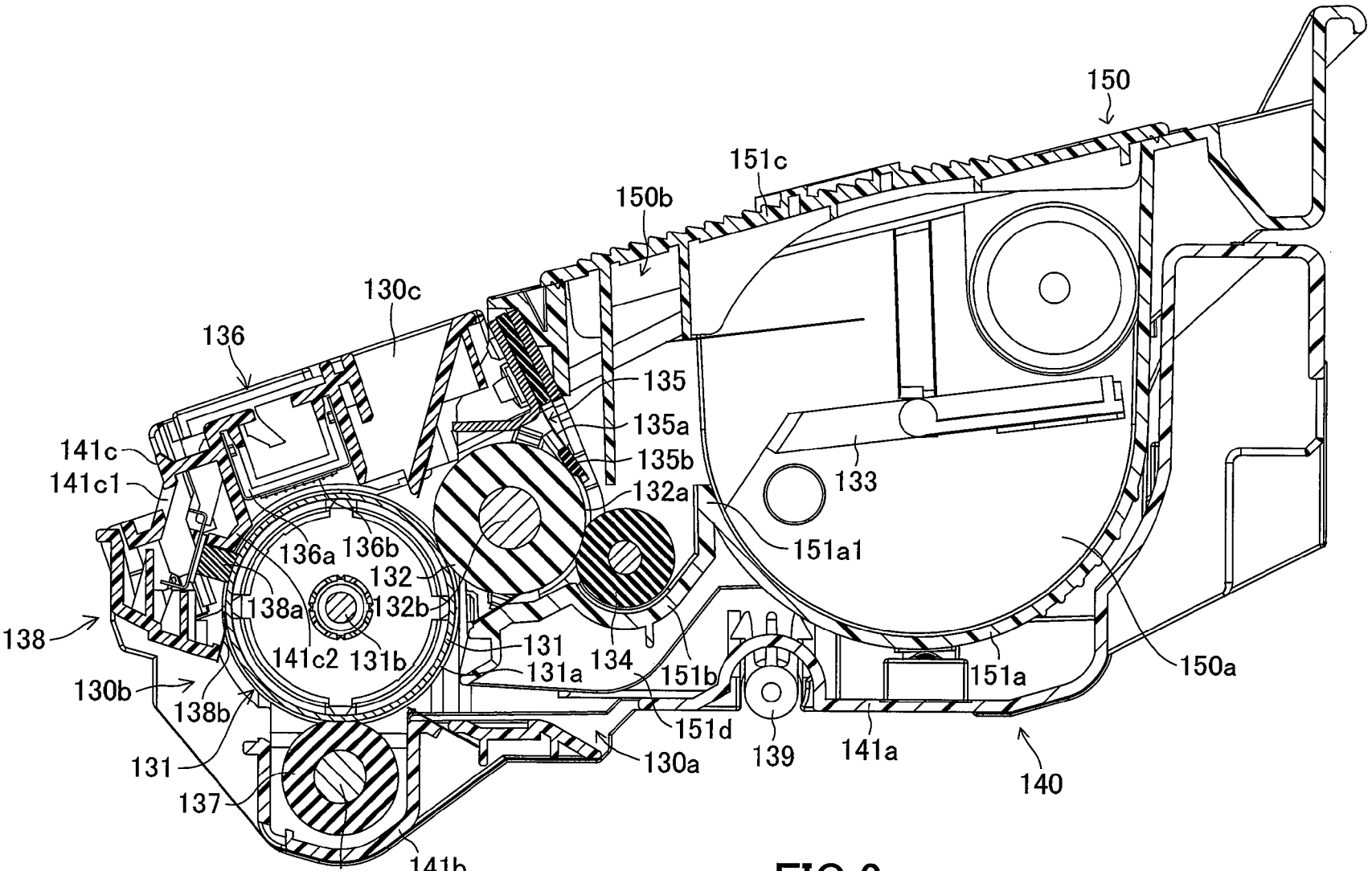
FIG. 2 is a side sectional view showing on an enlarged scale a process cartridge shown in FIG. 1.
Figure 3:
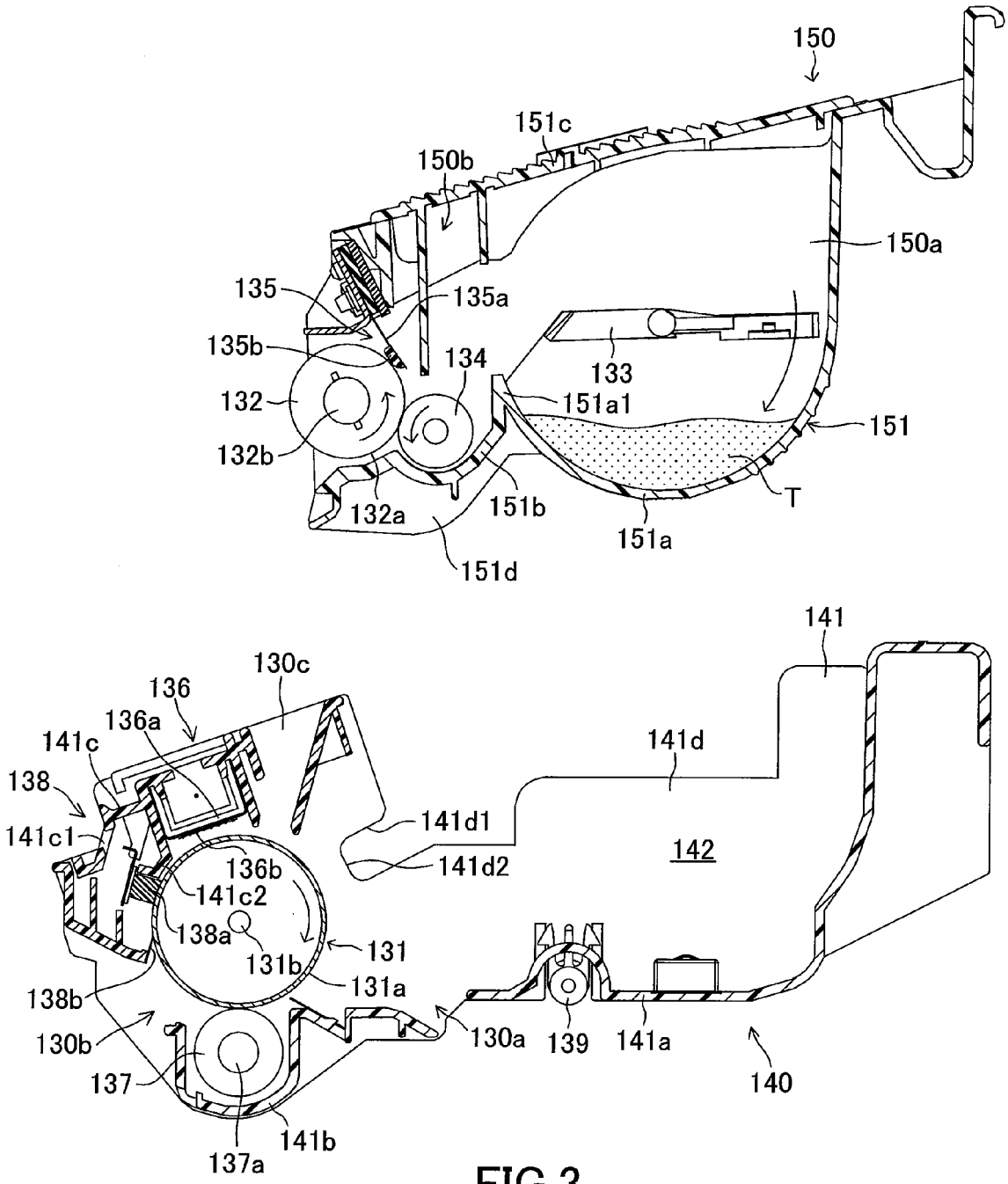
FIG. 3 is a side sectional view showing a state in which a drum unit and a development cartridge shown in FIG. 2 are separated from each other.

FIG. 2 is a side sectional view showing on an enlarged scale the process cartridge 130 shown in FIG. 1. FIG. 3 is a side sectional view showing in an exploded fashion the process cartridge 130 shown in FIG. 2. The internal configuration of the process cartridge 130 will next be described with reference to FIGS. 1 to 3.

<<<Photoconductor Drum>>>

Referring to FIGS. 1 and 2, the photoconductor drum 131 is a generally cylindrical member which includes a photoconductor layer serving as an outer circumferential portion thereof including the circumferential surface 131*a*, and a metal tube of aluminum or the like provided at the inside of the photoconductor layer. The photoconductor drum 131 is disposed in parallel with the paper width direction.

The photoconductor drum 131 is supported within the process cartridge 130 in such a manner as to be rotatably driven in the direction indicated by the arrow in FIG. 1 (clockwise) on a shaft 131*b* made of metal and electrically connected to the above-mentioned metal tube. The shaft 131*b* is grounded.

<<<Developing Roller>>>

Referring to FIG. 1, the process cartridge 130 accommodates a developing roller 132. The developing roller 132 is rotatably supported within the process cartridge 130.

Referring to FIG. 2, the developing roller 132 is disposed in parallel with the photoconductor drum 131 and faces the photoconductor drum 131. Specifically, the developing roller 132 is disposed in such a manner that a circumferential surface 132*a* of the developing roller 132 contacts the circumferential surface 131*a* of the photoconductor drum 131 under predetermined pressure.

The developing roller 132 is configured such that a semiconductive rubber layer is formed on a circumferential portion of a shaft 132*b* made of metal. The semiconductive rubber layer is made from a synthetic rubber to which carbon black is mixedly added. While being rotatably driven in the direction indicated by the arrow in FIG. 1 (counterclockwise), the developing roller 132 feeds positively charged toner T onto the circumferential surface 131*a* of the photoconductor drum 131 on which an electrostatic latent image is formed, thereby developing the electrostatic latent image.

<<<Configuration for Feeding Toner onto Developing Roller>>>

Referring to FIGS. 1 and 2, the process cartridge 130 accommodates an agitator 133. The agitator 133 is configured such that, when rotatably driven along the direction indicated by the arrow in FIG. 1 (clockwise), the agitator 133 sends a portion of the toner T toward the developing roller 132 while stirring the toner T contained in the process cartridge 130.

A feed roller 134 is disposed between the developing roller 132 and the agitator 133 and is in contact with the developing roller 132. The feed roller 134 is rotatably supported within the process cartridge 130. The feed roller 134 is configured such that a sponge layer is formed on a circumferential portion of a shaft made of metal. The feed roller 134 is configured such that, when rotatably driven in the direction indicated by the arrow in FIG. 1 (counterclockwise; in the same direction as the direction of rotation of the developing roller 132), the feed roller 134 rubs the toner T onto the circumferential surface 132*a* of the developing roller 132, thereby frictionally charging the circumferential surface 132*a* and causing the circumferential surface 132*a* to carry the toner T.

A toner-layer-thickness-regulating blade 135 is disposed in such a manner as to face a portion of the circumferential surface 132*a* of the developing roller 132 which is located downstream of the position of contact between the developing roller 132 and the feed roller 134 and upstream of the position of pressure contact between the developing roller 132 and the photoconductor drum 131, with respect to the direction of rotation of the developing roller 132.

Referring to FIG. 3, the toner-layer-thickness-regulating blade 135 includes a plate spring portion 135*a* and a contact portion 135*b*. The plate spring portion 135*a* is formed from a plate-like spring steel. An upper end portion (stationary end portion) of the plate spring portion 135*a* is fixed to an upper portion of the process cartridge 130. The contact portion 135*b* is attached to a lower end portion (free end portion) of the plate spring portion 135*a*. The contact portion 135*b* is a rubber chip whose longitudinal direction is in parallel with the paper width direction.

The toner-layer-thickness-regulating blade 135 is configured and disposed so as to regulate the thickness, density, and amount of static charges of the toner T on the circumferential surface 132*a* of the developing roller 132 through contact of the contact portion 135*b* with the circumferential surface 132*a* which carries the toner T as a result of sliding contact with the feed roller 134.

<<<Charger>>>

Referring to FIGS. 1 to 3, a charger 136 is disposed in such a manner as to face the circumferential surface 131*a* of the photoconductor drum 131. Specifically, the charger 136 is disposed in such a manner as to face a portion of the circumferential surface 131*a* of the photoconductor drum 131 which is located upstream of the position of irradiation with the laser beam (position where the circumferential surface 131*a* faces the laser irradiation opening 130*c*) with respect to the direction of rotation of the photoconductor drum 131. In the present embodiment, the charger 136 is disposed above the photoconductor drum 131.

The charger 136 of the present invention is a scorotron-type charger and includes a shield casing 136*a* and a grid 136*b*. The shield casing 136*a* is a box-like member which is made from metal and whose longitudinal direction is in parallel with the paper width direction, and is formed in such a manner as to surround a charging wire. The shield casing 136*a* has an opening portion which faces the circumferential surface 131*a* of the photoconductor drum 131 and to which the grid 136*b* is attached.

<<<Transfer Roller>>>

Referring to FIGS. 1 and 2, a transfer roller 137 is disposed under the photoconductor drum 131 and faces the photoconductor drum 131 with the paper transport path PP intervening therebetween. The transfer roller 137 is supported within the process cartridge 130 in such a manner as to be rotatably driven on a shaft 137*a*. The transfer roller 137 is configured such that an electrically conductive rubber layer is formed on a circumferential portion of the shaft 137*a* made of metal.

A high-voltage power supply is connected to the transfer roller 137 (shaft 137*a*). The transfer roller 137 is configured and disposed such that voltage applied between the transfer roller 137 and the circumferential surface 131*a* of the photoconductor drum 131 causes the toner T to be subjected to an electrostatic force directed from the circumferential surface 131*a* of the photoconductor drum 131 to the transfer roller 137, thereby transferring the toner T onto the surface of paper.

<<<Cleaning Section>>>

Referring to FIGS. 1 and 2, a cleaning section 138 is disposed laterally of the photoconductor drum 131. Specifically, the cleaning section 138 is disposed in such a manner as to face the circumferential surface 131*a* of the photoconductor drum 131 at a position which is located upstream of the position where the charger 136 and the circumferential surface 131*a* of the photoconductor drum 131 face each other, with respect to the direction of rotation of the photoconductor drum 131. Also, the cleaning section 138 is disposed in such a manner as to face the circumferential surface 131*a* of the photoconductor drum 131 at a position which is located downstream of the position where the transfer roller 137 and the circumferential surface 131*a* of the photoconductor drum 131 face each other with the paper transport path PP intervening therebetween, with respect to the direction of rotation of the photoconductor drum 131.

The cleaning section 138 is configured and disposed so as to clean the circumferential surface 131*a* of the photoconductor drum 131 before the circumferential surface 131*a* is uniformly charged by the charger 136. Referring to FIGS. 2 and 3, the cleaning section 138 includes a cleaning brush 138*a* and a lower film 138*b*.

The cleaning brush 138*a* is a member which constitutes the drum-cleaning member of the present invention, and is configured so as to clean (remove attached paper dust or the like from) the circumferential surface 131*a* of the rotating photoconductor drum 131 through contact with the circumferential surface 131*a*. The cleaning brush 138*a* is disposed in such a manner as to face the circumferential surface 131*a* of the photoconductor drum 131 at a position adjacent to the charger 136. The cleaning brush 138*a* is provided at a level higher than the shaft 131*b* of the photoconductor drum 131.

The lower film 138*b* is attached below the cleaning brush 138*a*. The lower film 138*b* is provided such that its free end projects upward. The lower film 138*b* is configured and disposed so as to restrain dropping of paper dust or the like scraped off by the cleaning brush 138*a* down to the paper transport path PP (see FIG. 1).

<<<Upper Resister Roller>>>

Referring to FIGS. 1 to 3, an upper resister roller 139 is provided for regulating the orientation and transport timing of paper and faces the exterior space of the process cartridge 130. The upper resister roller 139 is rotatably supported and is located upstream of the paper inlet opening 130*a* with respect to the paper transport direction.

<<Drum Unit>>

The process cartridge 130 includes a drum unit 140, which serves as the photoconductor unit of the present invention. The drum unit 140 includes the photoconductor drum 131, the charger 136, the transfer roller 137, the cleaning section 138, and the upper resister roller 139.

These members of the drum unit 140 are supported by a drum unit case 141, which serves as the casing of the drum unit 140. Specifically, the charger 136 and the cleaning section 138 (cleaning brush 138*a*) are fixed to the drum unit case 141. The drum unit case 141 is configured in such a manner as to rotatably support the photoconductor drum 131.

The specific configuration of the drum unit 140 of the present embodiment will be described below.

Referring to FIGS. 2 and 3, the upper resister roller 139 is rotatably supported at a lower portion of a drum unit case bottom plate 141*a*, which serves as a bottom plate of the drum unit case 141. A transfer roller accommodation section 141*b* is provided downstream (leftward in FIGS. 2 and 3) of the drum unit case bottom plate 141*a* with respect to the paper transport direction, with the paper inlet opening 130*a* located therebetween. The transfer roller accommodation section 141*b* is provided in such a manner as to cover the transfer roller 137 from underneath.

The transfer roller accommodation section 141*b* is a lower end portion of the drum unit case 141 and is located most downstream in the drum unit case 141 with respect to the paper transport direction. The paper inlet opening 130*a* is provided in such a manner as to face an upstream end portion of the transfer roller accommodation section 141*b* with respect to the paper transport direction. That is, the paper inlet opening 130*a* is formed between a downstream end portion (left end portion in FIGS. 2 and 3) of the drum unit case bottom plate 141*a* with respect to the paper transport direction and the upstream end portion (right end portion in FIGS. 2 and 3) of the transfer roller accommodation section 141*b* with respect to the paper transport direction.

A portion of the transfer roller accommodation section 141*b* which is located upstream of the transfer roller 137 with respect to the paper transport direction is formed in such a shape as to smoothly guide paper which is inserted through the paper inlet opening 130*a*, toward a transfer position at which the transfer roller 137 and the photoconductor drum 131 face each other. The paper outlet opening 130*b* is provided in such a manner as to face a downstream end portion of the transfer roller accommodation section 141*b* with respect to the paper transport direction.

<<<Configuration of Charger Support Section and its Periphery>>>

Referring to FIGS. 2 and 3, a charger support section 141*c* is provided above the transfer roller accommodation section 141*b*. That is, the paper outlet opening 130*b* is formed between a lower end portion of the charger support section 141*c* and a downstream end portion (left end portion in FIGS. 2 and 3) of the transfer roller accommodation section 141*b* with respect to the paper transport direction.

The charger support section 141*c* is configured so as to support the charger 136 and the cleaning section 138 (the cleaning brush 138*a* and the lower film 138*b*). The laser irradiation opening 130*c* is formed above the charger support section 141*c* and downstream of the charger 136 with respect to the direction of rotation of the photoconductor drum 131 (the clockwise direction in FIGS. 2 and 3). That is, the laser irradiation opening 130*c* is configured in such a manner as to allow upward exposure of the circumferential surface 131*a* of the photoconductor drum 131 which is uniformly charged by the charger 136.

The charger support section 141*c* has a plurality of slits 141*c*1 whose longitudinal direction is in parallel with the paper width direction and which are arranged along the paper width direction. The slits 141*c*1 face a space between the charger 136 and the cleaning brush 138*a* and are formed so as to allow communication between the space and the exterior of the drum unit case 141. This space is formed above the photoconductor drum 131; i.e., at a level higher than the shaft 131*b*.

The charger support section 141*c* has an integrally formed filler protrusion 141*c*2 which serves as the filler member of the present invention. The filler protrusion 141*c*2 is provided so as to fill the space between the charger 136 and the cleaning brush 138*a*. That is, the filler protrusion 141*c*2 is a portion of the drum unit case 141 which projects into the space between the charger 136 and the cleaning brush 138*a*.

Figure 9:
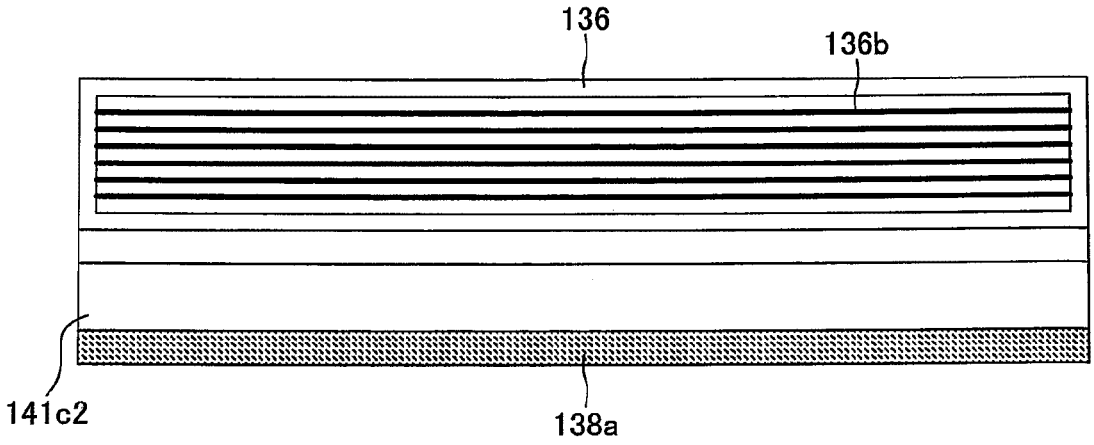
FIG. 9 is a front view of a filler member provided to fill a space between the charger and the drum-cleaning member over the overall length of the space along a paper width direction, wherein portions of laser printer have been removed for clarity.

The filler protrusion 141*c*2 is formed in such a manner as to fill the space between the charger 136 and the cleaning brush 138*a* over the overall length of the space along the paper width direction. FIG. 9 illustrates a front view of a portion of filler protrusion 141*c*2 provided to fill a space between the charger 136 and the cleaning member 138*a* over the overall length of the space alone a paper width direction, wherein portions of laser printer have been removed for clarity. The filler protrusion 141*c*2 is provided at a level higher than the shaft 131*b* of the photoconductor drum 131.

Figure 4:
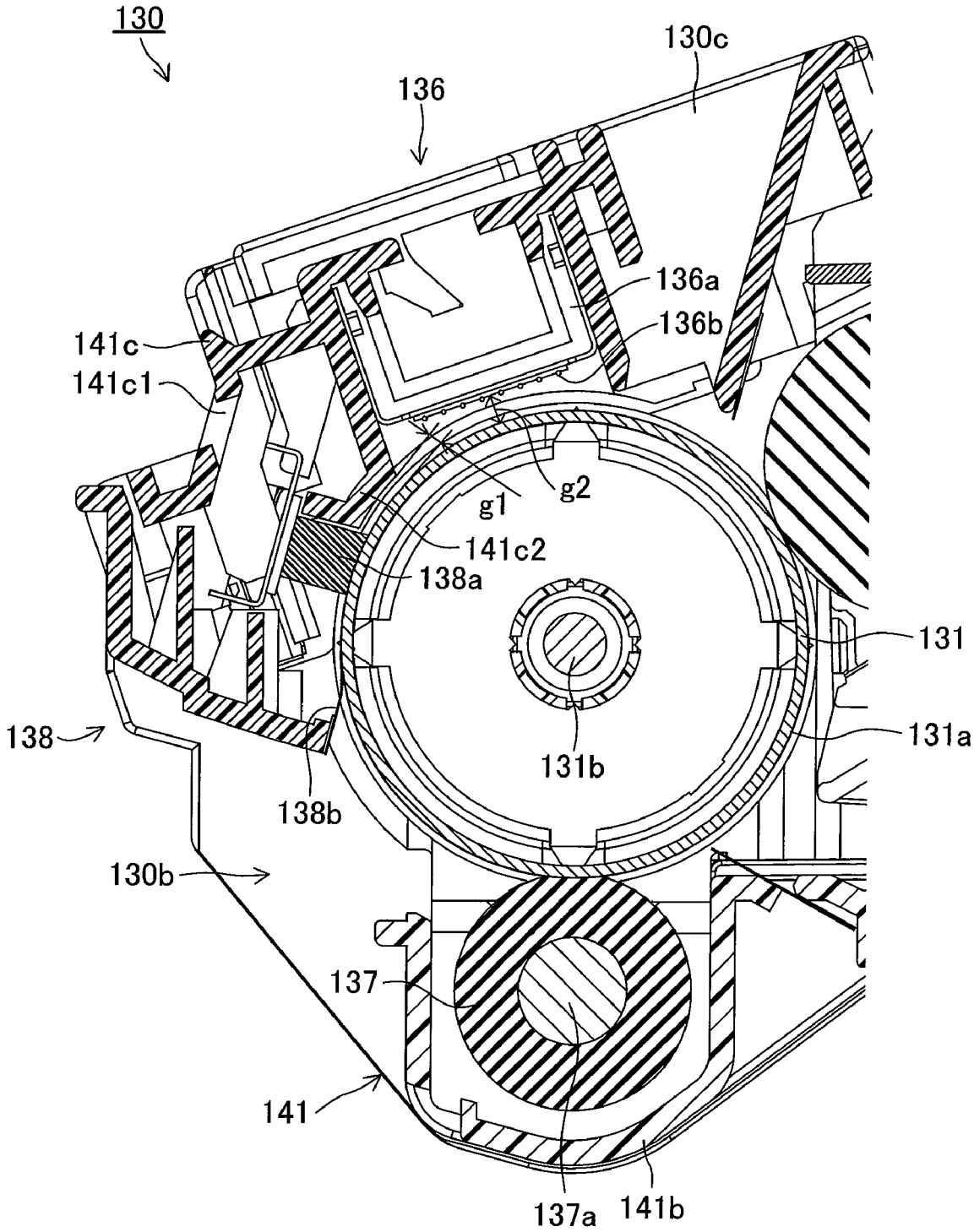
FIG. 4 is a side sectional view showing on an enlarged scale a filler protrusion shown in FIG. 2 and serving as the filler member of the present invention, and its periphery.

FIG. 4 is a side sectional view showing on an enlarged scale the filler protrusion 141*c*2 shown in FIG. 2 and serving as the filler member of the present invention, and its periphery.

Referring to FIG. 4, the filler protrusion 141*c*2 is provided in such a manner that a gap g1 between the filler protrusion 141*c*2 and the circumferential surface 131*a* of the photoconductor drum 131 is narrower than a gap g2 between the circumferential surface 131*a* and the grid 136*b* of the charger 136. The gap g1 is formed substantially constant.

That is, the filler protrusion 141*c*2 is provided in such a manner that the gap g9 between the circumferential surface 131*a* of the photoconductor drum 131 and the surface of the filler protrusion 141*c*2 which faces the circumferential surface 131*a* is constantly narrower than the gap g2 between the circumferential surface 131*a* and the charger 136.

<<<<Typical Modifications of Filler Member>>>>

Figure 5:
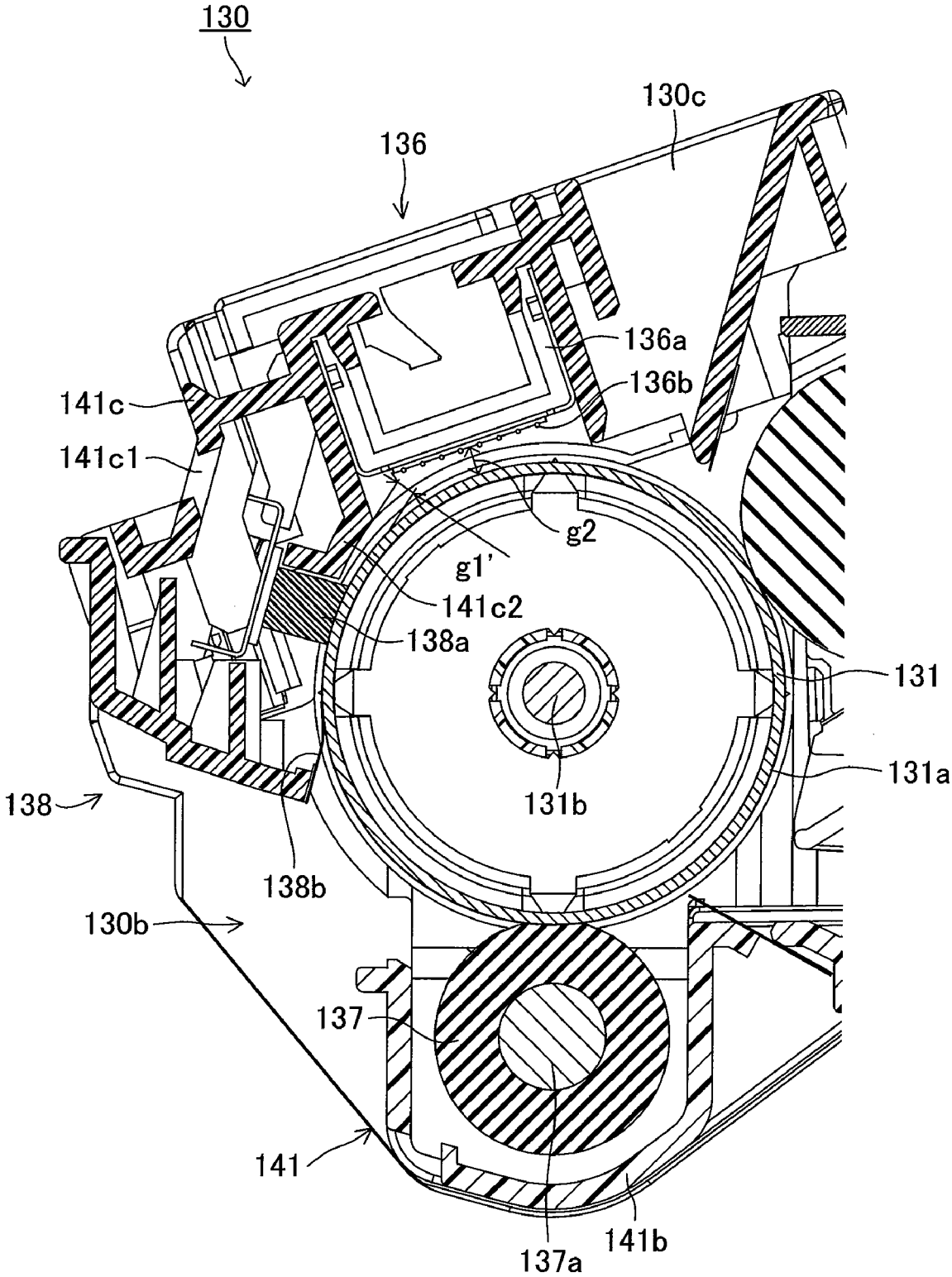
FIG. 5 is a side sectional view showing on an enlarged scale a first modification of the filler protrusion shown in FIG. 4.
Figure 6:
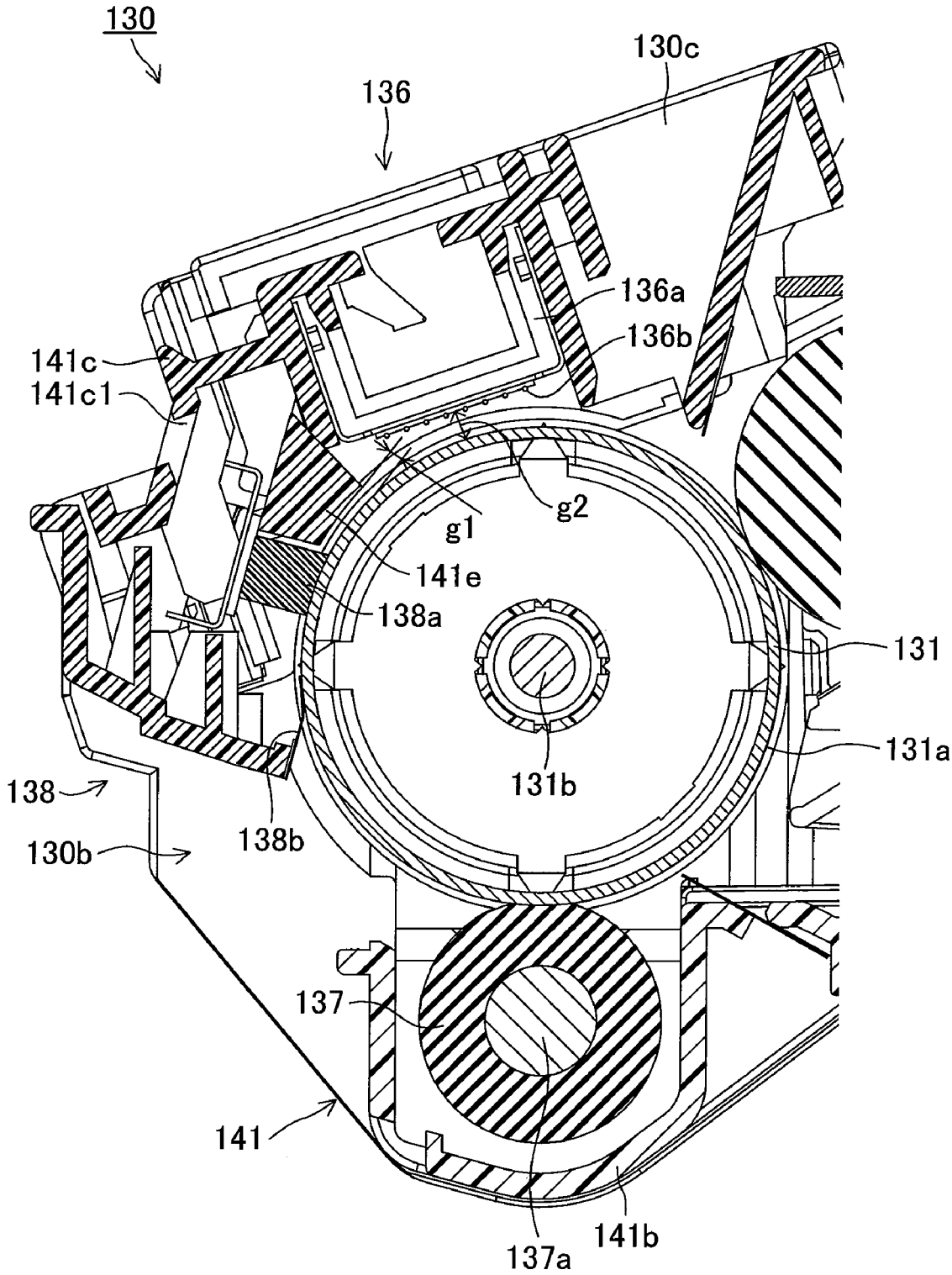
FIG. 6 is a side sectional view showing on an enlarged scale a second modification of the filler protrusion shown in FIG. 4.

FIGS. 5 and 6 are side sectional views showing on an enlarged scale modifications of the filler protrusion 141*c*2 shown in FIG. 4.

As shown in FIG. 5, according to a first modification, the filler protrusion 141*c*2 is formed in such a manner that the gap between the filler protrusion 141*c*2 and the circumferential surface 131*a* of the photoconductor drum 131 becomes narrower along the direction from the charger 136 to the cleaning brush 138*a*. Also, in this case, the filler protrusion 141*c*2 is provided in such a manner that a maximum gap g1' between the filler protrusion 141*c*2 and the circumferential surface 131*a* of the photoconductor drum 131 is narrower than the gap g2 between the circumferential surface 131*a* and the charger 136.

As shown in FIG. 6, according to a second modification, an additional filler member 141*e* is provided in place of the above-mentioned filler protrusion 141*c*2. Specifically, the additional filler member 141*e* for filling the space between the charger 136 and the cleaning brush 138*a* is provided separately from the charger support section 141*c*. In this case, the additional filler member 141*e* is fixed to the inside of the charger support section 141*c* at a position at which the additional filler member 141*e* faces the circumferential surface 131*a* of the photoconductor drum 131.

Figure 7:
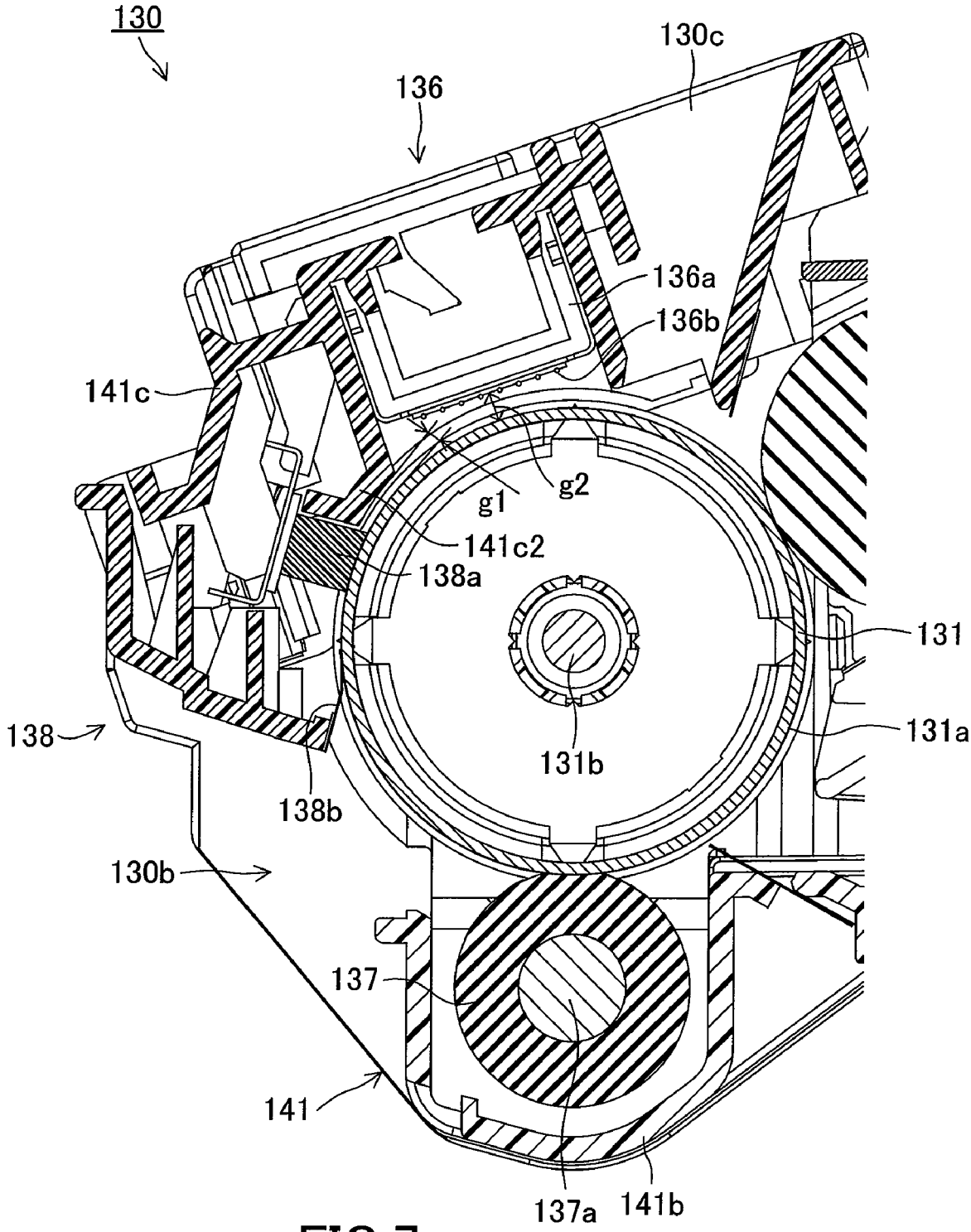
FIG. 7 is a side sectional view showing on an enlarged scale a modification of the drum unit shown in FIG. 4.

The above-mentioned filler protrusion 141*c*2 and additional filler member 141*e* can be provided in the charger support section 141*c* in which the slits 141*c*1 are not formed as shown in FIG. 7.

<<<Configuration Relative to Attachment/Detachment of Development Cartridge to/from Drum Unit>>>

Referring to FIGS. 2 and 3, a pair of drum unit case side plates 141*d* is plate-like members for rotatably supporting the photoconductor drum 131 and the transfer roller 137. The shaft 131*b* of the photoconductor drum 131 and the shaft 137*a* of the transfer roller 137 are supported and extend between the paired drum unit case side plates 141*d*.

Each drum unit case side plate 141*d* has a positioning opening 141*d*1. The positioning opening 141*d*1 is formed in such a manner that its one end portion (an end portion located on a side apart from the photoconductor drum 131) opens toward a development cartridge accommodation section 142. The other end portion (an end portion located on a side toward the photoconductor drum 131) of the positioning opening 141*d*1 has a positioning end face 141*d*2.

The positioning end faces 141*d*2 of the positioning openings 141*d*1 contact respective end portions of the shaft 132*b* of the developing roller 132, whereby the photoconductor drum 131 and the developing roller 132 can be brought into a predetermined positional relationship. That is, the positioning openings 141*d*1 are formed so as to position the photoconductor drum 131 and the developing roller 132 relative to each other.

The development cartridge accommodation section 142 is a space enclosed by the drum unit case bottom plate 141*a* and the paired drum unit case side plates 141*d*. The development cartridge accommodation section 142 is configured as a space for accommodating a development cartridge 150 to be described later. That is, the drum unit case 141 is configured in such a manner that the development cartridge 150 can be attached thereto/detached therefrom.

<<<Development Cartridge>>>

Referring to FIGS. 2 and 3, the development cartridge 150 is configured in such a manner that it can be attached to/detached from the drum unit case 141. FIG. 3 is a side sectional view showing a state in which the drum unit 140 and the development cartridge 150 shown in FIG. 2 are separated from each other.

The development cartridge 150 includes the developing roller 132, the agitator 133, the feed roller 134, and the toner-layer-thickness-regulating blade 135. The development cartridge 150 is configured so as to feed the toner T to an electrostatic latent image formed on the circumferential surface 131*a* of the photoconductor drum 131, thereby developing the electrostatic latent image.

The development cartridge 150 includes a toner accommodation chamber 150*a*, which is a space for accommodating (storing) the toner T, and a toner-layer-forming section 150*b* for forming a thin layer of the toner T having a predetermined thickness and density on the circumferential surface 132*a* of the developing roller 132. The toner accommodation chamber 150*a* and the toner-layer-forming section 150*b* are formed at the inside of a development cartridge case 151 which serves as the casing of the development cartridge 150. The agitator 133 is disposed within the toner accommodation chamber 150*a*. The developing roller 132, the feed roller 134, and the toner-layer-thickness-regulating blade 135 are disposed within the toner-layer-forming section 150*b*.

Referring to FIG. 3, a toner passage barrier 151*a*1 is formed at an end portion of a toner accommodation chamber bottom plate 151*a* which is located on a side toward the toner-layer-forming section 150*b*, the toner accommodation chamber bottom plate 151*a* serving as a bottom plate of the toner accommodation chamber 150*a*. The toner passage barrier 151*a*1 is configured so as to prevent outflow of the entire amount of the toner T accommodated within the toner accommodation chamber 150*a* to the toner-layer-forming section 150*b*. Specifically, the toner passage barrier 151*a*1 stands at a predetermined height such that a sufficient amount of the toner T is accommodated within the toner accommodation chamber 150*a* and such that the rotatably driven agitator 133 sends the toner T to the toner-layer-forming section 150*b* in a small amount at a time.

A toner-layer-forming section bottom plate 151*b* serves as the bottom plate of the toner-layer-forming section 150*b* and is provided in such a manner as to cover a lower portion of the feed roller 134 and a lower portion of the developing roller 132. The toner accommodation chamber bottom plate 151*a* and the toner-layer-forming section bottom plate 151*b* collectively serve as the bottom plate of the development cartridge case 151 and are integrally formed through injection molding of a synthetic resin.

The development cartridge case 151 includes a development cartridge case ceiling plate 151*c* and a pair of development cartridge case side plates 151*d* in addition to the above-mentioned toner accommodation chamber bottom plate 151*a* and toner-layer-forming section bottom plate 151*b*.

The development cartridge case ceiling plate 151*c* is disposed in such a manner as to face the toner accommodation chamber bottom plate 151*a* and the toner-layer-forming section bottom plate 151*b* with the toner accommodation chamber 150*a* and the toner-layer-forming section 150*b* located therebetween. The toner-layer-thickness-regulating blade 135 is fixed to an end portion of the development cartridge case ceiling plate 151*c* which is located on a side toward the toner-layer-forming section 150*b*. The paired development cartridge case side plates 151*d* rotatably support the developing roller 132, the agitator 133, and the feed roller 134.

A space enclosed by the toner accommodation chamber bottom plate 151*a*, the development cartridge case ceiling plate 151*c*, and the paired development cartridge case side plates 151*d* defines the above-mentioned toner accommodation chamber 150*a*. A space enclosed by the toner-layer-forming section bottom plate 151*b*, the development cartridge case ceiling plate 151*c*, and the paired development cartridge case side plate 151*d* defines the toner-layer-forming section 150*b*.

<<Configuration of Scanner Unit>>

Referring to FIG. 1, a scanner unit 160 is disposed within the body section 110 and above the process cartridge 130. The scanner unit 160 is configured so as to irradiate the circumferential surface 131*a* of the photoconductor drum 131 provided in the drum unit 140 with a laser beam which is modulated in accordance with image information, thereby forming an electrostatic latent image on the circumferential surface 131*a*.

The scanner unit 160 includes a scanner case 161, a polygon mirror 162, and reflectors 163, 164, and 165.

An unillustrated motor is fixed to the scanner case 161 and is rotatably driven at a predetermined rotational speed. The polygon mirror 162 is attached to a rotating drive shaft of the motor. The polygon mirror 162 is configured in such a manner that, while being rotatably driven by the motor, the polygon mirror 162 reflects a laser beam which is generated on the basis of image data in an unillustrated laser beam generator, whereby the laser beam sweeps along the paper width direction.

The reflectors 163, 164, and 165 are supported in the scanner case 161 in such a manner as to irradiate the laser beam (indicated by the alternate-long-and-short-dash line in FIG. 1) reflected by the polygon mirror 162 onto the circumferential surface 131*a* of the photoconductor drum 131 through the laser irradiation opening 130*c* formed in the process cartridge 130.

<<Configuration of Paper Feed Section>>

A paper feed section 170 is provided within the body section 110. The paper feed section 170 is configured so as to feed paper stored in the feeder unit 120 toward the process cartridge 130. The paper feed section 170 includes a paper feed roller 171, a paper-dust-removing roller 172, a paper-feed-roller paper guide 173, a process upper-course paper guide 174, a lower resister roller 175, and a process lower-course paper guide 176.

The paper feed roller 171 is rotatably supported by the body frame 112 of the body section 110. The paper feed roller 171 faces the separating pad 125 in such a manner that its circumferential surface contacts the separating pad 125 under a predetermined pressure.

The paper-dust-removing roller 172 is located frontward (downward with respect to the direction of rotation of the paper feed roller 171 as viewed during paper feed) of the separating pad 125 and is rotatably supported by the body frame 112. The paper-dust-removing roller 172 is disposed in such a manner that its circumferential surface contacts the paper feed roller 171.

The paper-feed-roller paper guide 173 is disposed in such a manner as to surround the paper feed roller 171. The paper-feed-roller paper guide 173 is a member for guiding a sheet of paper which is picked up by the paper feed roller 171 such that the sheet is transported along the paper transport path PP by the paper feed roller 171 while making a turn from the frontward direction to the rearward direction.

The process upper-course paper guide 174 is disposed so as to support paper from underneath in a region between a downstream end portion of the paper-feed-roller paper guide 173 with respect to the paper transport direction and the upper resister roller 139 disposed on a side toward the process cartridge 130. The process upper-course paper guide 174 is a member for guiding the paper which has left the paper roller 171, toward the process cartridge 130 along the paper transport path PP.

The lower resister roller 175 is adapted to adjust the orientation and transport timing of paper in cooperation with the upper resister roller 139. The lower resister roller 175 is disposed in such a manner as to face the upper resister roller 139 with the paper transport path PP intervening therebetween. The lower resister roller 175 is disposed upstream of the position at which the photoconductor drum 131 and the transfer roller 137 face each other, with respect to the paper transport direction.

The process lower-course paper guide 176 is disposed so as to support paper from underneath in a region between the paper outlet opening 130*b* and a fixing unit 180 to be described later.

<<Configuration of Fixing Unit>>

A fixing unit 180 serves as the fixing section of the present invention and is disposed within the body section 110 to be located downstream of the position at which the photoconductor drum 131 and the transfer roller 137 face each other, with respect to the paper transport direction.

Specifically, the fixing unit 180 is provided adjacent to the drum unit 140, which serves as the photoconductor unit of the present invention. The photoconductor drum 131, the charger 136, the cleaning section 138, and the charger support section 141*c* (the slits 141*c*1 and the filler protrusion 141*c*2) are provided at an end portion of the drum unit 140 which is located proximate to the fixing unit 180.

The fixing unit 180 is configured so as to fix an image of the toner T on paper through application of heat to the paper which bears the image and comes from the process cartridge 130. The fixing unit 180 includes a fixing-unit cover 181, a heat roller 182, and a pressure roller 183.

The fixing-unit cover 181 is a member intervening between the process cartridge 130, and the heat roller 182 and the pressure roller 183, so as to not heat the process cartridge 130 to possible extent.

The heat roller 182 is configured such that a halogen lamp is accommodated within a metal cylinder whose surface is subjected to an exfoliation treatment, and is rotatably supported within the fixing-unit cover 181 so as to be rotatably driven in the direction of the arrow in FIG. 1 (clockwise) by an unillustrated motor. The pressure roller 183 is a silicone rubber roller and is rotatably supported within the fixing-unit cover 181 so as to be rotated in the direction of the arrow in FIG. 1 (counterclockwise) while being pressed against the heat roller 182 under a predetermined pressure and following the heat roller 182.

<<Configuration of Paper Ejection Section>>

A paper ejection section 190 is provided within the body section 110 downstream of the fixing unit 180 with respect to the paper transport direction. The paper ejection section 190 is configured so as to eject paper coming from the fixing unit 180, to the exterior of the laser printer 100. The paper ejection section 190 includes a pair of paper transport rollers 191, a pair of paper ejection rollers 192, and a paper guide 193.

The paired paper transport rollers 191 are disposed in the vicinity of the outlet of the fixing unit 180 and are rotatably driven by an unillustrated motor. The paired paper ejection rollers 192 are disposed in the vicinity of the paper ejection port 111*c* and are rotatably driven by an unillustrated motor. The paper guide 193 is a member for guiding paper from the paper transport rollers 191 to the paper ejection rollers 192 along the paper transport path PP.

<Outline of Image-Forming Operation of Laser Printer>

The outline of an image-forming operation of the laser printer 100 having the above-described configuration will next be described with reference to the drawings.

<<Paper Feed Operation>>

Referring to FIG. 1, the paper-pressing plate 123 urges sheets of paper stacked thereon upward toward the paper feed roller 171. This causes the top sheet of a stack of paper on the paper-pressing plate 123 to contact the circumferential surface of the paper feed roller 171. When the paper feed roller 171 is rotatably driven in the direction of the arrow in FIG. 1 (counterclockwise), a leading end portion of the top sheet of paper is moved rightward in FIG. 1 and is nipped between the paper feed roller 171 and the separating pad 125. Then, as the paper feed roller 171 rotates, only the top sheet of paper is transported toward the paper-dust-removing roller 172.

Paper dust on paper which has reached the paper-dust-removing roller 172 is removed by the paper-dust-removing roller 172. Then, the paper is transported to a contact section (resist section) between the upper resister roller 139 and the lower resister roller 175 while being guided by the paper-feed-roller paper guide 173 and the process upper-course paper guide 174.

At certain timing after the leading end of paper butts against the resist section, the lower resister roller 175 is rotatably driven, and the upper resister roller 139 rotates as a result of being dragged by rotation of the lower resister roller 175. Thus, paper is transported to the transfer position at which the photoconductor drum 131 and the transfer roller 137 face each other. In this manner, a skew of paper is corrected, and transport timing is adjusted.

<<Forming Toner Image on Circumferential Surface of Photoconductor Drum>>

In the course of above-mentioned transport of paper toward the transfer position, an image of the toner T is carried on the circumferential surface 131*a* of the photoconductor drum 131 as described below.

First, the charger 136 uniformly charges a portion of the circumferential surface 131*a* of the photoconductor drum 131 to positive polarity.

Rotation of the photoconductor drum 131 in the direction of the arrow in FIG. 1 (clockwise) brings the portion of the circumferential surface 131*a* of the photoconductor drum 131 which is charged by the charger 136, to a position under the laser irradiation opening 130*c*. At the position under the laser irradiation opening 130*c*, the scanner unit 160 irradiates the uniformly charged portion of the circumferential surface 131*a* of the photoconductor drum 131 with a laser beam in such a manner as to sweep along the paper width direction. As mentioned previously, the laser beam is generated on the basis of image data. That is, the generation state (ON/OFF pulse pattern) of the laser beam is modulated in accordance with image data. The thus-modulated laser beam sweeps the charged portion of the circumferential surface 131*a* of the photoconductor drum 131, thereby forming an electrostatic latent image on the charged portion of the circumferential surface 131*a*.

Rotation of the photoconductor drum 131 in the direction of the arrow in FIG. 1 (clockwise) brings the electrostatic-latent-image-bearing portion of the circumferential surface 131*a* of the photoconductor drum 131 to a position at which the portion comes into contact with or close to the circumferential surface of the developing roller 132. The toner T charged to positive polarity is substantially uniformly carried on the circumferential surface of the developing roller 132 as described below.

Referring to FIG. 1, rotation of the feed roller 134 in the direction of the arrow in FIG. 1 (counterclockwise) causes the toner T to be affixed to the circumferential surface 132*a* of the developing roller 132. Rotation of the developing roller 132 in the direction of the arrow in FIG. 1 (counterclockwise) brings the portion of the circumferential surface 132*a* of the developing roller 132 to which the toner T is affixed by the feed roller 134, to a position of contact with the toner-layer-thickness-regulating blade 135. The toner-layer-thickness-regulating blade 135 regulates the amount of the toner T affixed to the circumferential surface 132*a* and the amount of static charges of the toner T affixed to the circumferential surface 132*a*. Rotation of the developing roller 132 in the direction of the arrow in FIG. 1 (counterclockwise) brings the portion of the circumferential surface 132*a* which has been regulated in the amount of the toner T affixed thereto and the amount of static charges of the toner T affixed thereto, to a position facing the photoconductor drum 131.

When the electrostatic-latent-image-bearing portion of the circumferential surface 131*a* of the photoconductor drum 131 and the charged-toner-T-carrying portion of the circumferential surface 132*a* of the developing roller 132 contact each other, the toner T is affixed to the image-bearing portion of the circumferential surface 131*a* of the photoconductor drum 131 in a pattern corresponding to the electrostatic latent image formed on the circumferential surface 131*a*. That is, the electrostatic latent image on the circumferential surface 131*a* of the photoconductor drum 131 is developed with the toner T, whereby an image of the toner T is carried on the circumferential surface 131*a*.

<<Transfer of Toner Image from Circumferential Surface of Photoconductor Drum to Paper>>

Referring to FIG. 1, rotation of the circumferential surface 131*a* of the photoconductor drum 131 in the direction of the arrow in FIG. 1 (clockwise) brings the image in the toner T which is carried on the circumferential surface 131*a* as mentioned above, to the above-mentioned transfer position. At the transfer position, the image in the toner T is transferred onto paper from the circumferential surface 131*a* of the photoconductor drum 131.

Through rotation in the direction of the arrow in FIG. 1 (clockwise), the portion of the circumferential surface 131*a* of the photoconductor drum 131 which has passed the transfer position reaches the cleaning section 138. The cleaning section 138 cleans off the remaining toner T and foreign matter such as dust from the portion of the circumferential surface 131*a*. The thus-cleaned portion of the circumferential surface 131*a* is again uniformly charged by the charger 136. In this manner, the circumferential surface 131*a* repeatedly undergoes an image-forming process.

<<Fixing and Paper Ejection>>

Paper on which an image of the toner T is transferred is sent to the fixing unit 180 along the paper transport path PP and is nipped between the heat roller 182 and the pressure roller 183 to thereby be subjected to pressure and heat. This fixes the image in the toner T on the surface of paper. Subsequently, the paper is sent to the paper ejection port 111*c* via the paper ejection section 190 and is ejected onto the catch tray 111*b* through the paper ejection port 111*c*.

<Actions and Effects of Embodied Configuration>

Figure 8:
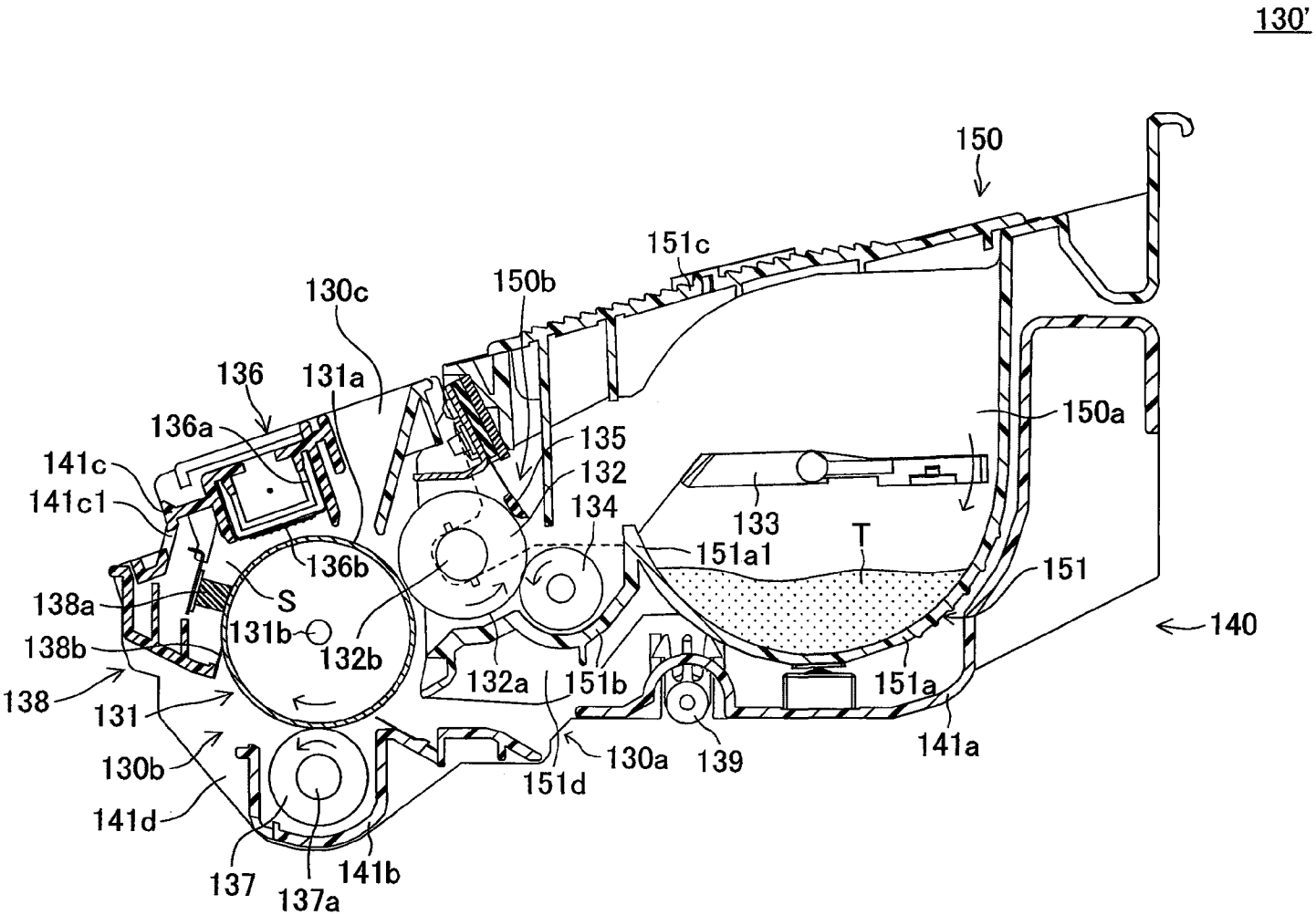
FIG.8 (Prior Art)
FIG. 8 is a side sectional view showing the configuration of a conventional process cartridge.

FIG. 8 is a side sectional view showing the configuration of a conventional process cartridge 130' (for convenience of explanation, components having the same structure and action as those of the above-described embodiment are denoted by the same reference numerals).

In the conventional process cartridge 130', a large space S is formed between the charger 136 and the cleaning brush 138*a*. The space S is formed above the photoconductor drum 131.

In the case where, after being turned off and left suspended all night, the laser printer 100 (see FIG. 1) employing the conventional process cartridge 130' is operated next day for image formation, a white streak may appear on a formed image along the main scanning direction. The width of the white streak as measured along the paper transport direction is substantially equal to the width of the space S as measured along the sub-scanning direction (along the direction of rotation of the photoconductor drum 131).

The white streak prominently appears when the environment during suspension after image formation on 1,000 or more sheets of size A4 (more prominently 10,000 sheets or more) is of high temperature and high humidity (e.g., 32° C. and 80%). Also, the longer the suspension time, more prominently the white streak appears.

Taken together, the above facts imply that the white streak is induced by a phenomenon that substances (an external additive of the toner T, etc.) filming the circumferential surface 131*a* of the suspended photoconductor drum 131 absorbs moisture. Conceivably, moisture absorption on the circumferential surface 131*a* results from absorption of moisture from air which is stagnant in the above-mentioned space S. Specifically, the following mechanism is conceivably involved.

While the power to the laser printer 100 (see FIG. 1) is ON, an air current is induced within the laser printer 100 by rotation of the photoconductor drum 131, operation of a cooling fan, etc. Thus, by virtue of the air current, air in the above-mentioned space S can be ejected to the exterior of the drum unit case 141 via a gap between the photoconductor drum 131 and the charger 136, the slits 141*c*1, etc. As shown in FIG. 1, the space S is formed in the vicinity of the fixing unit 180. Thus, air in the space S and the circumferential surface 131*a* of the photoconductor drum 131 slightly increase in temperature (e.g., up to about 40° C.).

When the power to the laser printer 100 (see FIG. 1) is turned off, the above-mentioned air current stops, and air stagnates in the space S. The air and the circumferential surface 131*a* of the photoconductor drum 131 drop in temperature. Because of condensation associated with the drop in temperature, substances (an external additive of toner T, etc.) filming the circumferential surface 131*a* of the suspended photoconductor drum 131 absorbs moisture. The absorption of moisture prevents appropriate formation of an electrostatic latent image on the circumferential surface 131*a* of the photoconductor drum 131, resulting in appearance of the white streak.

Particularly, the above-mentioned space S is formed at a level higher than the shaft 131*b* of the photoconductor drum 131. That is, the space S is formed above the circumferential surface 131*a* of the photoconductor drum 131. In such a configuration, because of sinking of highly humid air in the space S, the circumferential surface 131*a* of the photoconductor drum 131 is more likely to absorb moisture.

By contrast, as shown in FIGS. 4 to 6, in the above-described configurations according to the embodiment of the present invention and the modifications of the embodiment, the filler protrusion 141*c*2 or the additional filler member 141*e* fills the above-mentioned space S; i.e., the space between the charger 136 and the cleaning brush 138*a*.

These configurations can restrain stagnation of humid air in the space during suspension of an image-forming operation. This restrains absorption of moisture on the circumferential surface 131*a* of the photoconductor drum 131. Therefore, the configurations can restrain, to possible extent, the above-mentioned appearance of the white streak on an image which is formed after long-hour suspension.

In the above-described configurations according to the embodiment of the present invention and the modifications of the embodiment, the gaps g1 and g1' are set narrower than the gap g2 between the charger 136 and the circumferential surface 131*a* of the photoconductor drum 131. That is, the filler protrusion 141*c*2 or the additional filler member 141*e* is provided in such a manner that a gap between the circumferential surface 131*a* of the photoconductor drum 131 and the surface of the filler protrusion 141*c*2 or the surface of the additional filler member 141*e* which faces the circumferential surface 131*a* is constantly narrower than the gap g2 between the charger 136 and the circumferential surface 131*a*.

These configurations can more restrain the volume of a space where air can stagnate, in the space between the charger 136 and the cleaning brush 138*a*. This can more effectively restrain stagnation of humid air in the space between the charger 136 and the cleaning brush 138*a* during suspension of an image-forming operation.

In the embodiment shown in FIG. 4 and the first modification shown in FIG. 5, the filler protrusion 141*c*2 is formed as a portion of the drum unit case 141 (charger support section 141*c*) which projects into the space between the charger 136 and the cleaning brush 138*a*. That is, the filler protrusion 141*c*2 is integrally formed as a portion of the drum unit case 141 (charger support section 141*c*).

These configurations reduce the number of man-hours required for attaching the filler protrusion 141*c*2, thereby allowing manufacture of the drum unit 140 by a simpler manufacturing process.

In the first modification shown in FIG. 5, the filler protrusion 141*c*2 is provided in such a manner that the gap between the filler protrusion 141*c*2 and the circumferential surface 131*a* of the photoconductor drum 131 becomes narrower along the direction from the charger 136 to the cleaning brush 138*a*.

This configuration increases the flow rate of air which flows to the exterior of the space between the charger 136 and the cleaning brush 138*a* through the gap between the filler protrusion 141*c*2 and the circumferential surface 131*a* of the photoconductor drum 131. This can more effectively restrain stagnation of humid air in the space between the charger 136 and the cleaning brush 138*a* during suspension of an image-forming operation.

In the second modification shown in FIG. 6, the additional filler member 141*e* is formed as a separate member from the drum unit case 141 (charger support section 141*c*).

This configuration can readily restrain the above-mentioned appearance of the white streak on an image merely by attaching the additional filler member 141*e* to the conventional configuration as shown in FIG. 8.

Furthermore, as shown in FIG. 7, in the drum unit 140 in which the slits 141*c*1 are not formed in the charger support section 141*c*, the volume of an air communication path for allowing the space between the charger 136 and the cleaning brush 138*a* to communicate with the exterior space of the drum unit 140 is small. Even in this case, according to the above-mentioned configurations, the filler protrusion 141*c*2 or the like can restrain stagnation of humid air, thereby effectively restraining the above-mentioned appearance of the white streak.

<Suggestion of Other Modifications>

The above-described embodiment and typical modifications of the embodiment are a mere example of the best mode and its modifications which the applicant of the present invention contemplated at the time of filing the present application. The embodiment and modifications should not be construed as limiting the invention. Various modifications to the embodiment and modifications are possible so long as the invention is not modified in essence.

Several modifications other than those described above will next be exemplified. In the following description of the exemplified modifications and the above description of the embodiment and its modifications, members similar in structure and function are denoted by the same reference numerals. The above description of such members can be applied to the following exemplified modifications so long as no technical inconsistencies are involved.

Needless to say, modifications are not limited to those exemplified above and below. Also, a plurality of modifications can be combined as appropriate so long as no technical inconsistencies are involved.

The above embodiment and the above and following modifications should not be construed as limiting the present invention (particularly, those component elements which constitute means for solving the problems to be solved by the invention and are illustrated in terms of operations and functions).

(1) An application of the present invention is not limited to a monochromatic laser printer. For example, the present invention can be preferably applied to a color laser printer and to monochromatic and color copying machines.

(2) The charger 136 is not limited to a scorotron-type charger. In the case where the charger 136 is of a corotron type (the grid 136*b* is not provided), the gap g2 in FIGS. 4 to 6 becomes a gap between the shield casing 136*a* and the circumferential surface 131*a* of the photoconductor drum 131. Also, the charger 136 is not limited to a charger for positive charging.

(3) The configuration of the drum unit 140 is not limited to that of the above-described embodiment and modifications.

For example, the transfer roller 137 and/or the upper resister roller 139 may be provided on the body frame 112.

Also, the drum unit 140 may have the developing roller 132, the feed roller 134, and the toner-layer-thickness-regulating blade 135. That is, a toner cartridge having the toner accommodation chamber 150*a* and the agitator 133 may be removably attached to the drum unit 140.

Alternatively, the drum unit 140 and the development cartridge 150 may be configured integral with each other (in an inseparable manner). That is, the photoconductor unit of the present invention may include the photoconductor drum 131, the developing roller 132, the agitator 133, the feed roller 134, the toner-layer-thickness-regulating blade 135, the charger 136, and the cleaning section 138.

(4) The charger 136 and the cleaning section 138 may be disposed laterally of or downwardly of the photoconductor drum 131. In this case, the filler protrusion 141*c*2 and the additional filler member 141*e* can be disposed laterally of or downwardly of the photoconductor drum 131. Specifically, the filler protrusion 141*c*2 and the additional filler member 141*e* may be disposed at a level substantially equal to or lower than the shaft 131*b* of the photoconductor drum 131.

(5) In the configuration shown in FIG. 4, only a portion of the gap between the filler protrusion 141*c*2 and the photoconductor drum 131 which is located proximate to the charger 136 may be tapered as shown in FIG. 5.

(6) Those component elements which constitute means for solving the problems to be solved by the invention and are illustrated in terms of operations and functions include not only the specific structures disclosed in the above-described embodiment and modifications but also any other structures that can implement the operations and functions.

What is claimed is:

1. A photoconductor unit comprising:

a photoconductor drum having a cylindrical shape;

a charger disposed to face a circumferential surface of the photoconductor drum;

a cleaning section which includes:

a drum-cleaning member disposed adjacent to the charger to face the circumferential surface of the photoconductor drum, and configured to contact and clean the circumferential surface of the photoconductor drum;

a casing to which the charger and the drum-cleaning member are fixed and which is configured to rotatably support the photoconductor drum; and a filler member provided to fill a space between the charger and the drum-cleaning member over the overall length of the space along a paper width direction, wherein the filler member starts at the charger and extends to the drum-cleaning member.

2. A photoconductor unit according to claim 1, wherein:
the filler member is a portion of the casing which projects into the space between the charger and the drum-cleaning member.

3. A photoconductor unit according to claim 2, wherein:
the filler member is provided in such a manner that a gap between the filler member and the circumferential surface of the photoconductor drum is narrower than a gap between the charger and the circumferential surface of the photoconductor drum.

4. A photoconductor unit according to claim 3, wherein:
the filler member is provided in such a manner that the gap between the filler member and the circumferential surface of the photoconductor drum becomes narrower along a direction from the charger to the drum-cleaning member.

5. A photoconductor unit according to claim 4, wherein:
the filler member is provided in such a manner that a gap between the circumferential surface of the photoconductor drum and a surface of the filler member which faces the circumferential surface of the photoconductor drum is constantly narrower than the gap between the circumferential surface of the photoconductor drum and the charger.

6. A photoconductor unit according to claim 5, wherein:
the filler member is disposed at a level higher than a shaft of the photoconductor drum.

7. A photoconductor unit according to claim 3, wherein:
the filler member is provided in such a manner that a gap between the filler member and the circumferential surface of the photoconductor drum is substantially constant.

8. A photoconductor unit according to claim 1, wherein:
the filler member is provided separately from the casing and configured to be engaged with the casing.

9. An image-forming apparatus comprising:
a body frame;
a photoconductor unit attached to the body frame; and
a fixing section provided adjacent to the photoconductor unit and configured to fix an image in a developing agent on a recording medium through application of heat to the recording medium which bears the image and comes from the photoconductor unit,
wherein the photoconductor unit comprises:
a photoconductor drum having a cylindrical shape;
a charger disposed to face a circumferential surface of the photoconductor drum;
a cleaning section which includes:
a drum-cleaning member disposed adjacent to the charger to face the circumferential surface of the photoconductor drum, and configured to contact and clean the circumferential surface of the photoconductor drum;
a casing to which the charger and the drum-cleaning member are fixed and which is configured to rotatably support the photoconductor drum; and
a filler member provided to fill a space between the charger and the drum-cleaning member over the overall length of the space along a paper width direction,
wherein the tiller member starts at the charger and extends to the drum-cleaning member.

10. An image-forming apparatus according to claim 9, wherein:
the filler member is a portion of the casing which projects into the space between the charger and the drum-cleaning member.

11. An image-forming apparatus according to claim 10, wherein:
the filler member is provided in such a manner that a gap between the filler member and the circumferential surface of the photoconductor drum is narrower than a gap between the circumferential surface of the photoconductor drum and a lower end portion of the charger.

12. An image-forming apparatus according to claim 11, wherein:
the filler member is provided in such a manner that the gap between the filler member and the circumferential surface of the photoconductor drum becomes narrower along a direction from the charger to the drum-cleaning member.

13. An image-forming apparatus according to claim 12, wherein:
the filler member is provided in such a manner that a gap between the circumferential surface of the photoconductor drum and a surface of the filler member which faces the circumferential surface of the photoconductor drum is constantly narrower than the gap between the circumferential surface of the photoconductor drum and the charger.

14. An image-forming apparatus according to claim 13, wherein:
the filler member is disposed at a level higher than a shaft of the photoconductor drum.

15. A photoconductor unit according to claim 12, wherein:
the filler member is provided in such a manner that a gap between the filler member and the circumferential surface of the photoconductor drum is substantially constant.

16. A photoconductor unit according to claim 9, wherein:
the filler member is provided separately from the casing and configured to be engaged with the casing.

17. A photoconductor unit comprising:
a photoconductor drum having a cylindrical shape;
a charger disposed to face a circumferential surface of the photoconductor drum;
a cleaning section which includes:
a drum-cleaning member disposed adjacent to the charger to face the circumferential surface of the photoconductor drum, and configured to contact and clean the circumferential surface of the photoconductor drum;
a casing to which the charger and the drum-cleaning member are fixed and which is configured to rotatably support the photoconductor drum; and
a means for occupying a space between the charger and the drum-cleaning member over the overall length of the space along a paper width direction,
wherein the means starts at the charger and extends to the drum-cleaning member.

* * * * *